US011179770B2

(12) United States Patent
Le et al.

(10) Patent No.: US 11,179,770 B2
(45) Date of Patent: Nov. 23, 2021

(54) ELECTROMAGNETIC SEMI-CONTINUOUS CASTING DEVICE AND METHOD HAVING ACCURATELY MATCHED AND ADJUSTED COOLING PROCESS

(71) Applicant: Northeastern University, Shenyang (CN)

(72) Inventors: Qichi Le, Shenyang (CN); Yonghui Jia, Shenyang (CN); Tong Wang, Shenyang (CN); Lei Bao, Shenyang (CN); Jian Hou, Shenyang (CN); Jiashi Yan, Shenyang (CN)

(73) Assignee: Northeastern University, Shenyang (CN)

( * ) Notice: Subject to any disclaimer, the term of this patent is extended or adjusted under 35 U.S.C. 154(b) by 0 days.

(21) Appl. No.: 17/043,540

(22) PCT Filed: Aug. 29, 2019

(86) PCT No.: PCT/CN2019/103219
§ 371 (c)(1),
(2) Date: Sep. 29, 2020

(87) PCT Pub. No.: WO2021/035602
PCT Pub. Date: Mar. 4, 2021

(65) Prior Publication Data

US 2021/0245239 A1 Aug. 12, 2021

(30) Foreign Application Priority Data

Aug. 28, 2019 (CN) ..... 201910801689.0

(51) Int. Cl.
*B22D 11/049* (2006.01)
*B22D 11/055* (2006.01)
*B22D 11/124* (2006.01)

(52) U.S. Cl.
CPC ..... *B22D 11/049* (2013.01); *B22D 11/055* (2013.01); *B22D 11/1246* (2013.01)

(58) Field of Classification Search
CPC .. B22D 11/049; B22D 11/055; B22D 11/1246
See application file for complete search history.

(56) References Cited

FOREIGN PATENT DOCUMENTS

CN 101844209 A 9/2010
CN 102581238 A 7/2012
(Continued)

*Primary Examiner* — Kevin P Kerns
*Assistant Examiner* — Steven S Ha
(74) *Attorney, Agent, or Firm* — Muncy, Geissler, Olds & Lowe, P.C.

(57) ABSTRACT

An electromagnetic semi-continuous device comprises a crystallizer frame, an internal sleeve, a primary cooling water cavity, a secondary cooling water cavity and a tertiary cooling water cavity. An electromagnetic semi-continuous casting method comprises the steps of (1) adjusting angles of the adjustable spherical nozzles; (2) inserting a dummy bar head in a bottom of the internal sleeve; (3) feeding cooling water to the primary cooling water cavity and the secondary cooling water cavity, then spraying the cooling water to form primary cooling water and secondary cooling water, and exerting a magnetic field on the internal sleeve; (4) pouring the melts into the internal sleeve, starting the dummy bar head, and beginning to perform continuous casting; and (5) spraying tertiary cooling water through the tertiary cooling water cavity, so that casting billets reduce temperature until the continuous casting is completed.

10 Claims, 4 Drawing Sheets

(56) References Cited

FOREIGN PATENT DOCUMENTS

| | | | |
|---|---|---|---|
| CN | 106925736 | A | 7/2017 |
| CN | 108405821 | A | 8/2018 |
| CN | 108637200 | A | 10/2018 |
| CN | 208083396 | U | 11/2018 |
| JP | 2003290880 | A | 10/2003 |

ELECTROMAGNETIC SEMI-CONTINUOUS CASTING DEVICE AND METHOD HAVING ACCURATELY MATCHED AND ADJUSTED COOLING PROCESS

BACKGROUND OF THE INVENTION

1. Field of the Invention

The present invention relates to a casting device and method, and more specifically to an electromagnetic semi-continuous casting device and method having an accurately matched and adjusted cooling process.

2. The Prior Arts

At present, metal round billets and flat billets, especially aluminum, copper, magnesium and its alloys thereof are produced and prepared mainly through a direct-chill casting (DC) technique, a crystallizer is a core component in the whole alloy fusion casting process, and whether the crystallizer is reasonable in structure or not directly affects downstream deformation processing properties and whether product quality is qualified or not, so that developing and manufacturing of a casting crystallizer tooling are always the key to casting industry.

With development of rail transit, aerospace, communication electronics and military industry of China, demands for large-size and high-quality billets and large and medium-sized structural sections are ever growing. But when large-size billets are prepared by an existing semi-continuous casting method, problems that structures are thick and non-uniform, ingredients are serious in segregation and cracks are easy to generate, exist inevitably. In addition, for alloys high in hot tearing susceptibility, such as ZK60 magnesium alloys, Mg-RE alloys (RE is greater than or equal to 3% and smaller than or equal to 15%), and aluminum alloys high in alloy content, large-size billets cannot be prepared yet at present. For Mg—Li alloys, the structure of a traditional crystallizer even has the risk that cooling water spatters to high temperature melts to cause explosion. Main reasons for the above-mentioned defects include: a cooling system of a conventional casting crystallizer is single and is not adjustable in structure form, the spraying angle of cooling water of a single crystallizer to billet is not changeable, the intensity of the cooling water is adjusted often through adjusting water quantity/water pressure, and the adjusting range is limited. Therefore, melt cooling has orientation from inside to outside, different parts of the transverse section of each casting billet have large differences in temperature gradients and cooling rate, liquid sumps can be formed in the longitudinal section of each casting billet, and tensile stress generated during solidification and contraction of the casting billets can generate an axial component, to cause deformation of casting billets after initial solidifying and shaping. And along with increase of secondary cooling intensity, the casting billets are non-uniform in local cooling to generate surface cracks, which results in cracking of casting billets finally.

Researches show that generation of stress can be effectively restrained through reducing the cooling intensity at the initial stage of casting, and micro-structures can be effectively refined and the quality of the casting billets can be effectively improved through increasing the cooling intensity at the stabilization stage of casting. In addition, internal and external temperature differences of the casting billets can be effectively decreased through exerting an electromagnetic field, so that the temperature distribution of melts in liquid sump is uniform in distribution, and generation of casting cracks can be effectively restrained. Chinese patent CN101844209A, entitled "Crystallizer Adjustable in Angle of Cooling Water for Aluminum Alloy Casting", discloses a crystallizer for aluminum alloy casting, adjustable in angle of secondary cooling water, but the angle of primary cooling is not adjustable, a cooling intensity adjusting range is only limited to adjustment of cooling water quantity/water pressure, an adjustable range is quite limited, but primary cooling is vital to formation of initial structure of the casting billets and formation of stress state. Chinese patent CN10251238A, entitled "Crystallizer Variable in Cooling Intensity for Semi-continuous Casting of Aluminum Alloys", discloses a crystallizer for semi-continuous casting, capable of adjusting cooling intensity through arranging a decompression cavity, the situation that the cooling water spatters to high temperature metal melts due to too large secondary cooling water pressure is avoided, but the cooling water is not adjustable in direction, and the crystallizer is poor in adaptability and complex in structure. Chinese patent CN106925736A, entitled "Electromagnetic Treatment Device of Semi-continuous Casting Melts in Liquid Sump, and Working Method of Electromagnetic Treatment Device", and Chinese patent CN108405821A, entitled "Casting Device and Method for No-crack Large-specification Magnesium Alloy Flat Billets", both disclose a crystallizer for treatment and casting of electromagnetic melts, but the cooling intensity and the angle of the cooling water are not both adjustable, and requirements for production and preparation of alloys high in hot tearing susceptibility cannot be met. In addition, for the crystallizer disclosed in the patents, primary cooling and secondary cooling are mutually correlated, the cooling intensity cannot be independently adjusted, the primary cooling and the secondary cooling are poor in harmony, but reasonable distribution of primary cooling intensity and secondary cooling intensity is vital to the micro-structure and the stress state of the casting billets. Therefore, developing and manufacturing of an electromagnetic casting crystallizer tooling adjustable in the cooling intensity and the direction of the cooling water simultaneously are key to production and preparation of alloys high in hot tearing susceptibility, and are problems to be solved in metal billet preparation industry.

SUMMARY OF THE INVENTION

For various problems existing in an existing semi-continuous casting crystallizer, a primary objective of the present invention is to provide an electromagnetic semi-continuous casting device and method. Two independent cooling water cavities are arranged outside an internal sleeve of a crystallizer and are assembled on a height-adjusting device, and nozzles are arranged on the two independent cooling water cavities to correspond to the internal sleeve; and through adjusting the positions of the cooling water cavities and the nozzles, a cooling manner is accurately adjusted and matched in a semi-continuous casting process, and generation requirements of alloys high in hot tearing susceptibility are met.

To achieve the above objectives, the present invention provides an electromagnetic semi-continuous casting device comprises a crystallizer frame, an internal sleeve, a primary cooling water cavity, a secondary cooling water cavity a tertiary cooling water cavity, at least four lifting plates and at least two fixing plates.

A central hole is formed in a top plate of the crystallizer frame, and an upper interface plate is placed in the central hole.

The internal sleeve is barrel-shaped, a connecting plate is fixed to an outer wall of an upper part of the internal sleeve, and the internal sleeve is located in the upper interface plate and is fixedly connected with the upper interface plate.

The primary cooling water cavity and the secondary cooling water cavity are arranged outside the internal sleeve in a circumferential direction, two excitation coils are respectively arranged in the primary cooling water cavity and the secondary cooling water cavity, and a plurality of adjustable spherical nozzles are assembled at a plurality of water outlets of the primary cooling water cavity and the secondary cooling water cavity respectively, and the adjustable spherical nozzles face to the internal sleeve.

At least two lifting plates are arranged on outer walls of the primary cooling water cavity and at least two lifting plates are arranged on outer walls of the secondary cooling water cavity, each of the lifting plate is formed with an internal thread hole, a plurality of screws are respectively threaded into the internal thread holes on the lifting plates, a bottom end of each screw is fixed to a lower bearing, and outer parts of the lower bearings are fixed to a bottom plate of the crystallizer frame.

An upper part of each screw is fixed to an inner part of an upper bearing, a hand wheel is assembled at a top end of each screw, and outer parts of the upper bearings are fixed to the top plate of the crystallizer frame.

The top plate and the bottom plate of the crystallizer frame are fixed together through a plurality of support rods.

The tertiary cooling water cavity is located below the secondary cooling water cavity, a plurality of water outlet holes is formed in the tertiary cooling water cavity and face to a side wall of the internal sleeve or below the internal sleeve, at least two fixing plates are arranged on an outer wall of the tertiary cooling water cavity, a plurality of internal thread holes are formed in the fixing plates respectively, and a plurality of screw rods assembled on the bottom plate of the crystallizer frame are respectively threaded into the internal thread holes in the fixing plates.

A casting billet passage is formed in the bottom plate of the crystallizer frame.

In the device, two or more water inlets are formed in the primary cooling water cavity and two or more water inlets are formed in the secondary cooling water cavity, and each water inlet communicates with a water inlet pipe.

In the device, the water outlets of the primary cooling water cavity and the secondary cooling water cavity are respectively divided into an upper row and a lower row, an inner diameter of each of the adjustable spherical nozzles at each of the water outlets is 1-4 mm, a distance between every two adjacent water outlets in the upper row is 5-20 mm, and a distance between every two adjacent water outlets in the lower row is 5-20 mm.

In the device, the upper interface plate is an integral structure formed by a horizontal annular plate and a perpendicular annular plate, the horizontal annular plate is mutually perpendicular with the perpendicular annular plate, and the horizontal annular plate is located on an outer side of the perpendicular annular plate; wherein a top surface of the horizontal annular plate is connected with the connecting plate, and a bottom surface of the horizontal annular plate is connected with the top plate of the crystallizer frame; and wherein a plurality of bolt holes of the perpendicular annular plate correspond to a plurality of thread holes in the internal sleeve respectively, the perpendicular annular plate is fixed to the internal sleeve through a plurality of bolts which are threaded into the bolt holes and the thread holes, and the perpendicular annular plate is located between an internal end surface of the top plate of the crystallizer frame and an outer wall of the internal sleeve.

In the device, a horizontal section of the internal sleeve is round or rectangle with round corners; wherein an inner wall surface of the internal sleeve is parallel to an axis of the internal sleeve, or an included angle which is smaller than or equal to 5 degrees is formed between the inner wall surface of the internal sleeve and the axis of the internal sleeve; wherein when the included angle is formed between the inner wall surface of the internal sleeve and the axis of the internal sleeve, a section area of a top portion of an inner space of the internal sleeve is smaller than that of a bottom portion of the internal sleeve; and wherein a perpendicular section of a lower part of an outer wall surface of the internal sleeve is a wedge, and a part where the perpendicular section is the wedge is located below the bottom plate of the crystallizer frame.

In the device, the device further comprises four screws; wherein the four screws are arranged on the crystallizer frame in total, two lifting plates are arranged on the primary cooling water cavity and two lifting plates are arranged on the secondary cooling water cavity, two of the screws are respectively threaded into two internal thread holes on the two lifting plates of the primary cooling water cavity, and two of the screws are respectively threaded into the two internal thread holes on the two lifting plates of the secondary cooling water cavity; and wherein the two screws threaded into the two internal thread holes on the two lifting plates of the primary cooling water cavity are called primary screws, the two screws threaded into the two internal thread holes on the two lifting plates of the secondary cooling water cavity are called secondary screws, and the two primary screws and the two secondary screws are in cross distribution in a circumferential direction of the crystallizer frame.

In the device, the excitation coil in the primary cooling water cavity is fixed to a bolt through two coil pressing plates, and the excitation coil in the secondary cooling water cavity is fixed to a bolt through two coil pressing plates; wherein a plurality of cable through holes are respectively formed in side walls of the primary cooling water cavity and the secondary cooling water cavity; and wherein a plurality of cables connected with the excitation coils penetrate through the cable through holes to be connected with a power supply.

In the device, the primary cooling water cavity and the secondary cooling water cavity both consist of a water cavity external sleeve and a water cavity cover plate, wherein the water cavity external sleeve of the primary cooling water cavity is an integral structure formed by an outer side wall, an inner side wall and a water cavity bottom plate, and the water cavity external sleeve of the secondary cooling water cavity is an integral structure formed by an outer side wall, an inner side wall and a water cavity bottom plate; wherein the water cavity cover plate of the primary cooling water cavity covers on top of the water cavity external sleeve of the primary cooling water cavity and is connected with the water cavity external sleeve of the primary cooling water cavity through a plurality of bolts, a sealing groove is formed in the water cavity cover plate of the primary cooling water cavity, and the water cavity cover plate of the primary cooling water cavity and the water cavity external sleeve of the primary cooling water cavity are sealed through a sealing gasket; wherein the water cavity cover plate of the secondary cooling water cavity covers on top of the water cavity external sleeve of the secondary cooling water cavity and is connected with the water cavity external sleeve of the secondary cooling water cavity through a plurality of bolts, a sealing groove is formed in the water cavity cover plate of the secondary cooling water cavity, and the water cavity cover plate of the secondary cooling water cavity and the water cavity external sleeve of the secondary cooling water cavity are sealed through a sealing gasket; and wherein two of the lifting plates are arranged on an outer side wall of the water cavity external sleeve and two of the lifting plates are arranged on an outer side wall of the water cavity external sleeve of the secondary cooling water cavity, a plurality of water inlets and a plurality of cable through holes are formed in the outer side wall of the water cavity external sleeve of the primary cooling water cavity and the outer side wall of the water cavity external sleeve of the secondary cooling water cavity, and the water outlets are formed in an inner side wall of the water cavity external sleeve of the primary cooling water cavity and an inner side wall of the water cavity external sleeve of the secondary cooling water cavity.

In the device, each of the water outlets of the primary cooling water cavity and the secondary cooling water cavity is an internal thread structure, and the water outlets and the adjustable spherical nozzles are assembled together through threads.

In the device, the upper bearings and the lower bearings are fixed onto the top plate of the crystallizer frame and the bottom plate of the crystallizer frame through a plurality of bearing fixing devices respectively.

To achieve the above objectives, the present invention provides an electromagnetic semi-continuous casting method for the device, comprising the following steps:

1. adjusting angles of the adjustable spherical nozzles;

2. inserting a dummy bar head in a bottom of the internal sleeve;

3. feeding cooling water to the primary cooling water cavity and the secondary cooling water cavity, and then spraying the cooling water to an outer wall of the internal sleeve through the adjustable spherical nozzles of the primary cooling water cavity and the secondary cooling water cavity; wherein the cooling water sprayed from the primary cooling water cavity is called primary cooling water, the cooling water sprayed from the secondary cooling water cavity is called secondary cooling water, the primary cooling water and the secondary cooling water flow towards the lower part of the internal sleeve along the outer wall of the internal sleeve, and a magnetic field is exerted on an inner part of the internal sleeve through the excitation coils;

4. pouring melts into the internal sleeve through a chute, and gradually solidifying the melts under an action of cooling of the internal sleeve and an action of the magnetic field to form casting billets at the bottom of the internal sleeve, when the melts in the internal sleeve achieve a set height, starting the dummy bar head to enable solidified casting billets to move downwards, and beginning to perform continuous casting;

5. when bottom of the casting billets are separated from the internal sleeve, enabling the primary cooling water and the secondary cooling water to flow to surfaces of the casting billets from the internal sleeve, at this time, spraying tertiary cooling water to an outer wall surface of the internal sleeve or the surfaces of the casting billets through the tertiary cooling water cavity, and reducing temperature of the casting billets until the continuous casting is completed.

In step 1, the angles of the adjustable spherical nozzles are adjusted through a direction adjusting device, the direction adjusting device consists of a flat plate and a plurality of terminals fixed on the flat plate, an arrangement mode of the terminals corresponds to an arrangement mode of a part of the adjustable spherical nozzles; and wherein when the angles of the adjustable spherical nozzles are adjusted through the direction adjusting device, each terminal is inserted into a nozzle hole of the corresponding adjustable spherical nozzle, the flat plate is turned over, and at the same time, the included angle between a part of the adjustable spherical nozzles and the water level is adjusted once.

In step 1, the angles of the adjustable spherical nozzles are adjusted through the direction adjusting device when each adjustable spherical nozzle is provided with an extension pipe, the direction adjusting device is a flat plate with a plurality of adjusting holes, an arrangement mode of the adjusting holes corresponds to an arrangement mode of a part of the adjustable spherical nozzles; and wherein when the angles of the adjustable spherical nozzles are adjusted through the direction adjusting device, each adjusting hole sleeves the corresponding extension pipe, the flat plate is turned over, and at the same time, the included angle between a part of the adjustable spherical nozzles and the water level is adjusted once.

In the method, when the casting billets are round billets, a flow ratio of the secondary cooling water to the primary cooling water is 0.8-1.2, whereby an accurately matched and adjusted cooling process can be achieved; and wherein when the casting billets are flat billets, a flow ratio of the secondary cooling water to the primary cooling water is 0.8-1.2, besides, a flow ratio of the secondary cooling water of a narrow surface of each casting billet to the secondary cooling water of a wide surface of each casting billet is 0.8-1.0, and a flow ratio of the primary cooling water of the narrow surface of each casting billet to the primary cooling water of the wide surface of each casting billet is 0.8-1.0, whereby an accurately matched and adjusted cooling process can be achieved.

In the method, a casting speed is 10-100 mm/min.

In the method, a flow ratio of the tertiary cooling water to the primary cooling water is 0.3-0.8.

In the method, the casting billets are magnesium alloys, aluminum alloys, purity copper or copper alloys.

In the method, the casting billets are round billets or flat billets, a diameter of the round billets is 300-800 mm, a width of the flat billets is 500-1800 mm, and a width-to-thickness ratio of the flat billets is 1-5.

In the method, the screws rotate through rotating the hand wheels, so that a height of the primary cooling water cavity or a height of the secondary cooling water cavity can be adjusted; wherein when the height of the primary cooling water cavity and the height of the secondary cooling water cavity are H, a height difference between the water cavity cover plate of the primary cooling water cavity and the top plate of the crystallizer frame is 0-0.5 H, and a height difference between the water cavity cover plate of the secondary cooling water cavity and the water cavity bottom plate of the primary cooling water cavity is 0.2-1 H.

In the method, a height of the tertiary cooling water cavity is adjusted through rotating the screw rods assembled on the bottom plate of the crystallizer frame; wherein when the casting billets are Mg—Li alloys, the water outlet holes of the tertiary cooling water cavity face to a lower part of an outer wall surface of the internal sleeve, and a perpendicular distance between the tertiary cooling water cavity and the secondary cooling water cavity is 0-100 mm; and wherein when the casting billets are not Mg—Li alloys, the water outlet holes of the tertiary cooling water cavity are controlled to face to a lower part of a bottom end of the internal sleeve, and a perpendicular distance between the tertiary cooling water cavity and the secondary cooling water cavity is 60-200 mm.

A conventional semi-continuous casting crystallizer is a structure in which primary cooling is correlated with secondary cooling, primary cooling is contact heat transfer between the internal sleeve and the alloy melts, the secondary cooling is convective heat transfer between the cooling water and the surfaces of the casting billets, cooling of each stage cannot be independently adjusted, in addition, the intensity adjusting range of the cooling water is extremely limited, and the direction of the cooling water cannot be adjusted. Therefore, a conventional crystallizer cannot meet requirements for preparation of alloys being high in hot tearing susceptibility and Mg—Li alloy casting billets. For the above defects, the electromagnetic semi-continuous casting device and method disclosed by the present invention is multi-stage independent cooling, the primary cooling, the secondary cooling and the tertiary cooling, which are independently adjustable are formed; wherein the intensity and the direction of the primary cooling water and the intensity and the direction of the secondary cooling water are independently adjustable, the excitation coils are arranged in the primary cooling water cavity and the secondary cooling water cavity, melt convective vibration effects of different forms can be generated, and the tertiary cooling water cavity is a conventional cooling manner, and the height is adjustable. The cooling water can be directly sprinkled to the metal casting billets to generate high cooling intensity, and at the same time, the cooling water can also be sprinkled to the metal internal sleeve to reduce the cooling intensity.

Compared with a conventional casting crystallizer, the electromagnetic semi-continuous casting device and method disclosed by the present invention has multi-stage independently-regulated cooling water cavities, and the height of the cooling water cavities and the volume and the sprinkling angle of the cooling water can be independently adjusted, so that the electromagnetic semi-continuous casting device and method disclosed by the present invention is suitable for preparation of casting billets of various alloy type. The primary cooling water cavity and the secondary cooling water cavity are respectively provided with upper-layer and lower-layer cooling water outlets, so that the cooling range is enlarged. The adjustable spherical nozzles are used in cooling water outlets, so that the volume and the direction of the cooling water can be regulated in a large range. Through combination of a combined assembling manner of the upper interface plate and the metal internal sleeve with the self-weight of the metal internal sleeve, fixing and positioning of the internal sleeve can be completed only through a flange having a small width, bolted connection is not needed, the internal sleeve is simple to assemble and disassemble, and easy to maintain and service, and the cost is saved. The excitation coils are respectively arranged in the primary cooling water cavity and the secondary cooling water cavity, so that exerting of a single-phase magnetic field or a differential phase magnetic field can be realized, and melt convective vibration effects of different forms are generated. And in addition, through the structure adjustable in height, the electromagnetic semi-continuous casting device and method disclosed by the present invention are suitable for an alloy casting process having different liquid sump depths.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
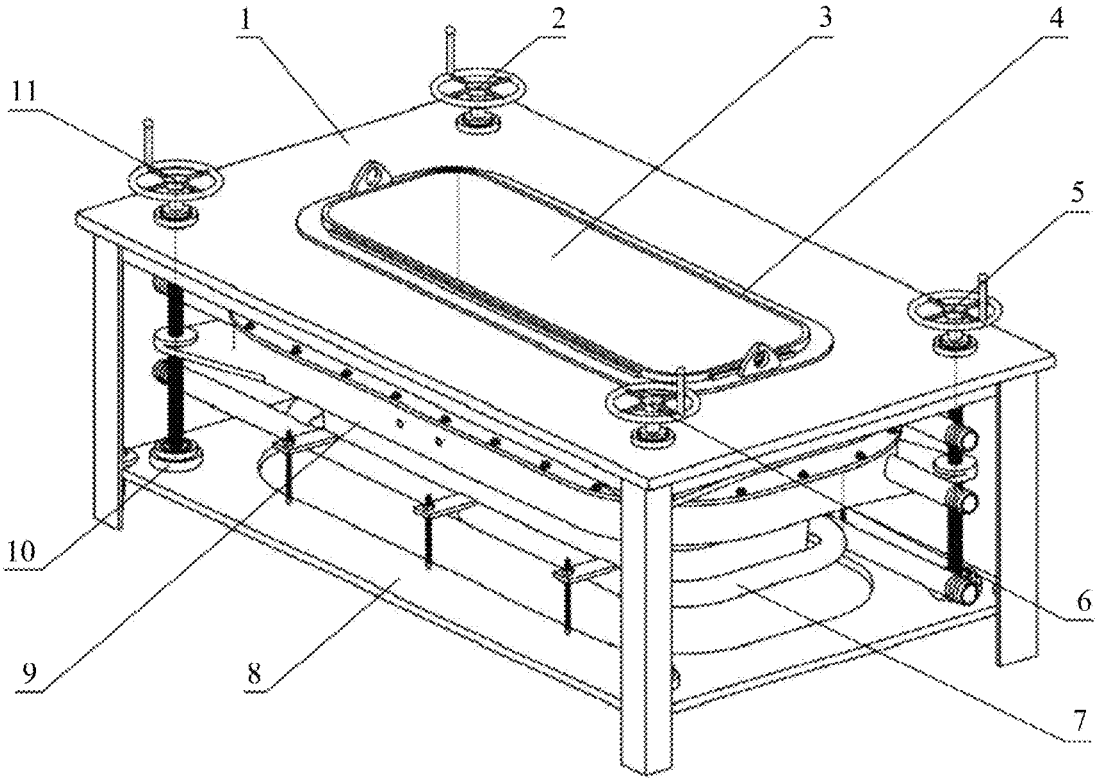
FIG. 1 shows a perspective view of an electromagnetic semi-continuous casting device according to an embodiment 1 of the present invention.

The accompanying drawings are included to provide a further understanding of the invention, and are incorporated in and constitute a part of this specification. The drawings illustrate embodiments of the invention and, together with the description, serve to explain the principles of the invention.

An internal sleeve in the embodiments of the present invention is made of red copper, 6061 aluminum alloys, 6063 aluminum alloys, 6082 aluminum alloys, titanium alloys or austenitic stainless steel.

Heights H of a primary cooling water cavity and a secondary cooling water cavity in the embodiments of the present invention are the same, and H is equal to 80-140 mm.

A height of the internal sleeve in the embodiments of the present invention is 220-500 mm, and a thickness of a part of the internal sleeve except a wedge part of the internal sleeve and a connecting plate is 8-30 mm.

When the internal sleeve in the embodiments of the present invention is made of the red copper, a chromium coating having a thickness being 0.04-0.16 mm is coated on an inner wall surface of the internal sleeve.

A thickness of an upper interface plate in the embodiments of the present invention is 3-8 mm.

A diameter of each of bolt holes in the upper interface plate in the embodiments of the present invention is 8-10 mm, and a distance between every two adjacent bolt holes is 100-400 mm.

Adjustable spherical nozzles in the embodiments of the present invention are products purchased in the market, and an inner diameter of each of the adjustable spherical nozzles is 1-4 mm.

An included angle between each adjustable spherical nozzle (facing upwards or downwards) in the embodiments of the present invention and the water level is smaller than or equal to 60 degrees.

A distance between every two adjacent adjustable spherical nozzles in an upper row in the embodiments of the present invention is 5-20 mm. A distance between every two adjacent adjustable spherical nozzles in a lower row in the embodiments of the present invention is 5-20 mm.

A horizontal distance between each adjustable spherical nozzle and the internal sleeve in the embodiments of the present invention is 10-40 mm.

Excitation coils in the embodiments of the present invention are solenoid coils, Cramer winding coils or tooth profile winding coils.

Electromagnetic wires are used for the excitation coils in the embodiments of the present invention are dual-layer polyimide-fluorine 46 composite tape wrapped rectangular copper wires which are 2-4 mm in thickness and 2-10 mm in width, or round water pump wires which are 2-5 mm in diameter.

Currents through the excitation coils in the primary cooling water cavity and the secondary cooling water cavity in the embodiments of the present invention are the same electric currents or electric currents having phase differences, wherein the phase differences are 60 degrees, 90 degrees or 120 degrees.

A tertiary cooling water cavity in the embodiments of the present invention is a pipeline type structure, a transverse section of the pipeline is round or rectangular, and the pipeline is 2-6 mm in wall thickness, 700-5000 $mm^2$ in section area and made of steel. A plurality of water outlet holes of the tertiary cooling water cavity are round holes having hole diameter being 1-4 mm, or the water outlet holes are rectangular holes having the same section area as that of the round holes. The water outlet holes of the tertiary cooling water cavity are formed into a row in a circumferential direction of the internal sleeve, and a distance between every two adjacent water outlet holes is 5-20 mm.

In the embodiments of the present invention, a perpendicular distance between the upper-row water outlets and the lower-row water outlets of the primary cooling water cavity is 80-140 mm, and a perpendicular distance between the upper-row water outlets and the lower-row water outlets of the secondary cooling water cavity is 80-140 mm.

In the embodiments of the present invention, a perpendicular distance between the upper-row water outlets of the primary cooling water cavity and a top surface of the primary cooling water cavity is 5-20 mm, a perpendicular distance between the lower-row water outlets of the primary cooling water cavity and a bottom surface of the primary cooling water cavity is 5-20 mm, a perpendicular distance between the upper-row water outlets of the secondary cooling water cavity and a top surface of the secondary cooling water cavity is 5-20 mm, and a perpendicular distance between the lower-row water outlets of the secondary cooling water cavity and a bottom surface of the secondary cooling water cavity is 5-20 mm.

In the method disclosed by the present invention, when the casting billets are made of alloys high in hot tearing susceptibility, a height difference between a water cavity cover plate of the secondary cooling water cavity and a water cavity bottom plate of the primary cooling water cavity is 0.7-1 H.

In the embodiments of the present invention, when angles of the adjustable spherical nozzles of the primary cooling water cavity and the secondary cooling water cavity are adjusted, included angle between an axis of each adjustable spherical nozzle and the water level is controlled to be smaller than or equal to 60 degrees.

In the method disclosed by the present invention, when the casting billets are made of alloys high in hot tearing susceptibility, the included angle between the axis of each adjustable spherical nozzle of the primary cooling water cavity and the water level is smaller than or equal to 30 degrees, and the included angle between the axis of each adjustable spherical nozzle of the secondary cooling water cavity and the water level is 30-60 degrees.

In the method disclosed by the present invention, the angle of each of the adjustable spherical nozzles is adjusted according to a depth of a liquid sump and a thickness of a solidifying shell near the liquid sump. When the depth of the liquid sump is greater than a required depth or the thickness of the solidifying shell near the liquid sump is greater than a required thickness, the angle of each of the adjustable spherical nozzles is adjusted downwards to reduce a temperature reduction speed of melts above the liquid sump and increase heat dissipation below the liquid sump, so as to reduce the depth of the liquid sump or reduce the thickness of the solidifying shell near the liquid sump.

The excitation coils in the embodiments of the present invention are solenoid coil windings, an electromagnetic condition during working includes that electric currents are 60-150 A, a frequency is 15-25 Hz, and a duty cycle is 20-30%.

In the method disclosed by the present invention, when the casting billets are aluminum alloys or magnesium alloys, a lubricant between melts and the internal sleeve in the casting process is lubricating oil. And when the casting billets are copper or copper alloys, the lubricant between the melts and the internal sleeve in the casting process is carbon powder, and besides, an effect of preventing oxidation can be achieved.

In the method disclosed by the present invention, after casting is finished, the internal sleeve and the upper interface plate are hoisted together through a hoisting hole in the upper interface plate, a complex cooperating structure is not needed, disassembling and assembling are simple, and the cooling water cavities and the metal internal sleeve are convenient to maintain and service.

In the method disclosed by the present invention, a casting speed is 10-100 mm/min.

Embodiment 1

Figure 2:
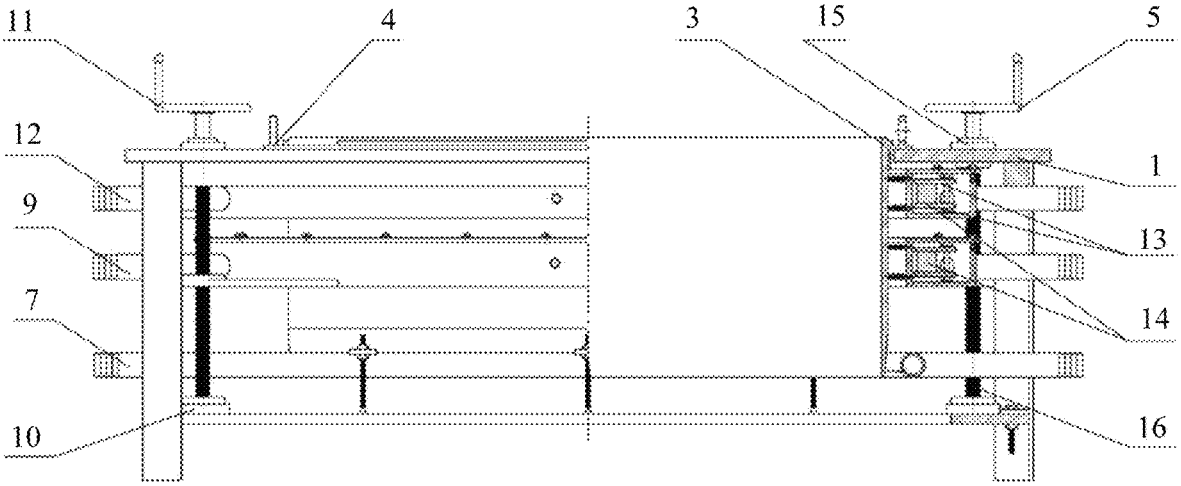
FIG. 2 shows a cross-sectional view of the electromagnetic semi-continuous casting device according to the embodiment 1 of the present invention.
Figure 3:
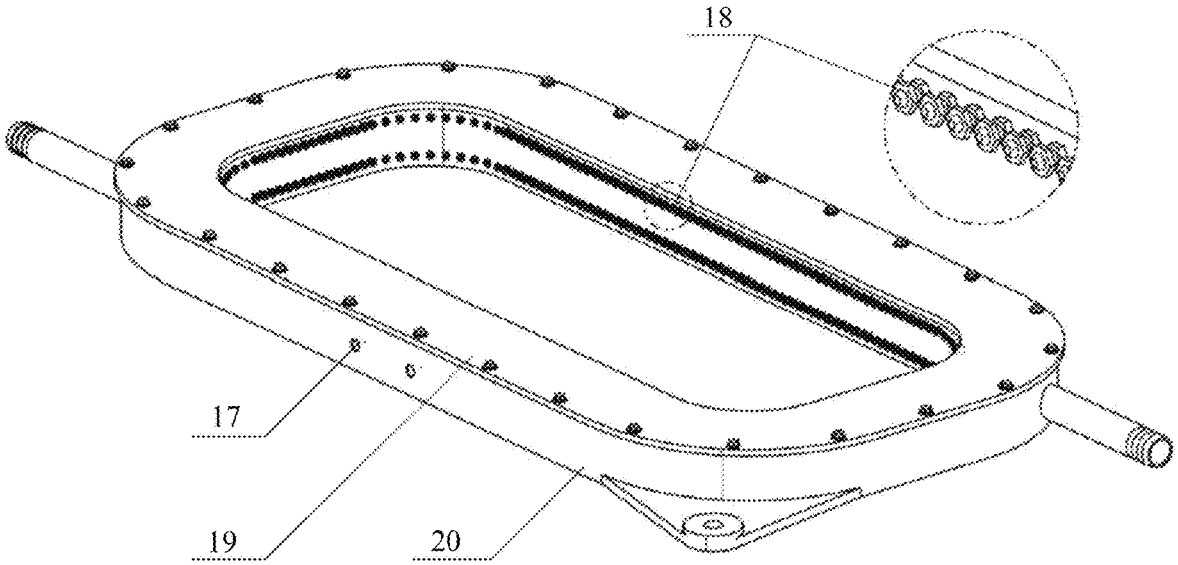
FIG. 3 shows a schematic diagram of the structure of a primary cooling water cavity according to the embodiment 1 of the present invention.

Referring to FIGS. 1 and 2, FIG. 1 shows a perspective view of an electromagnetic semi-continuous casting device according to the embodiment 1 of the present invention, and FIG. 2 shows a cross-sectional view of the electromagnetic semi-continuous casting device according to the embodiment 1 of the present invention. As shown in FIGS. 2 and 3, an electromagnetic semi-continuous casting device comprises a crystallizer frame 1, an internal sleeve 3, a primary cooling water cavity 12, a secondary cooling water cavity 9 a tertiary cooling water cavity 7, four lifting plates, six fixing plates and a plurality of screws 16.

Figure 4:
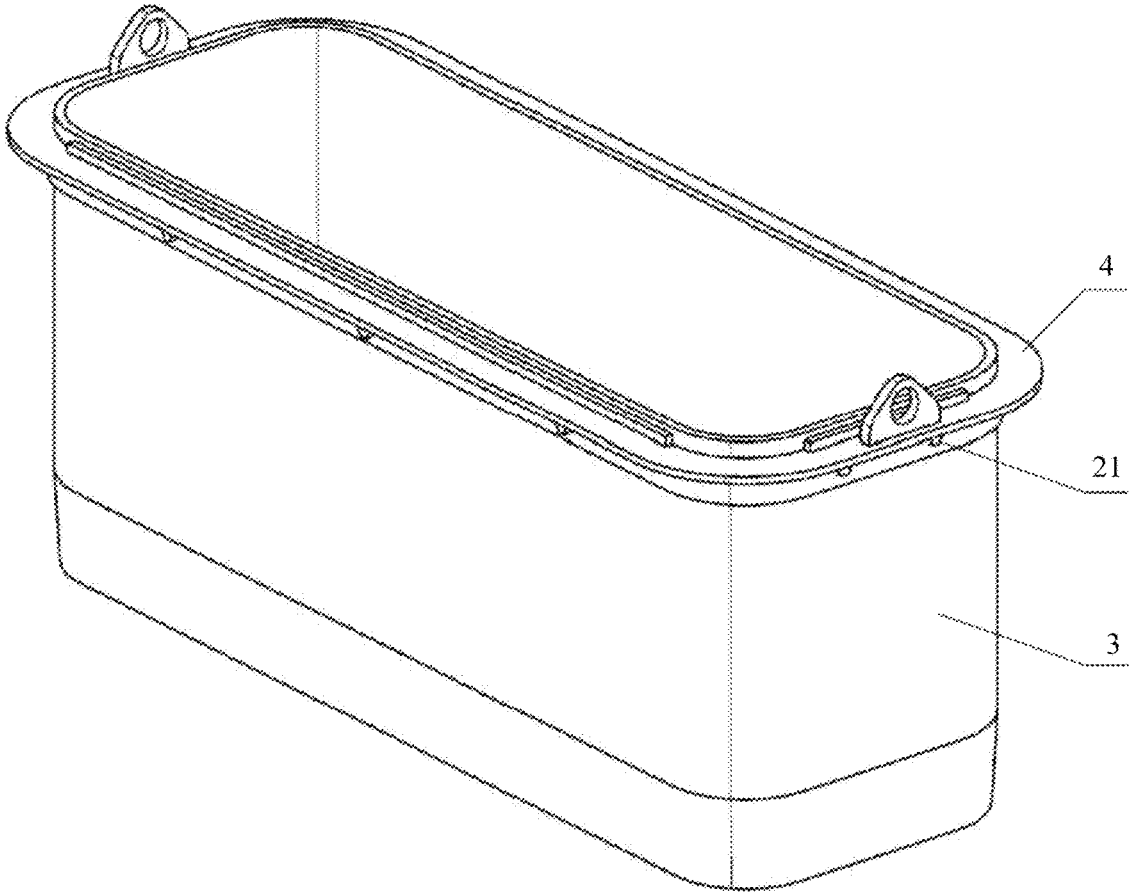
FIG. 4 shows a schematic diagram of the structure of parts of an internal sleeve and an upper interface plate in FIG. 1.

A central hole is formed in a top plate of the crystallizer frame 1, and an upper interface plate 4 is placed in the central hole. The internal sleeve 3 is barrel-shaped, a connecting plate is fixed to an outer wall of an upper part of the internal sleeve 3. Referring to FIG. 4, FIG. 4 shows a schematic diagram of the structure of parts of the internal sleeve 3 and the upper interface plate 4 in FIG. 1. As shown in FIG. 4, the internal sleeve 3 is located in the upper interface plate 4 and is fixedly connected with the upper interface plate 4.

The primary cooling water cavity 12 and the secondary cooling water cavity 9 are arranged outside the internal sleeve 3 in a circumferential direction, and two excitation coils 14 are respectively arranged in the primary cooling water cavity 12 and the secondary cooling water cavity 9.

The structures of the primary cooling water cavity 12 and the secondary cooling water cavity 9 are the same. Referring to FIG. 3, FIG. 3 shows a schematic diagram of the structure of a primary cooling water cavity according to the embodiment 1 of the present invention. As shown in FIG. 3, a plurality of adjustable spherical nozzles 18 are assembled at a plurality of water outlets of the primary cooling water cavity 12 and the secondary cooling water cavity 9 respectively, and the adjustable spherical nozzles face to the internal sleeve 3. Two lifting plates are arranged on an external wall of the primary cooling water cavity 12 and two lifting plates are arranged on an external wall of the secondary cooling water cavity 9, each of the lifting plate is formed with an internal thread hole, a plurality of screws 16 are respectively threaded into the internal thread holes on the lifting plates, a bottom end of each screw 16 is fixed to a corresponding lower bearing, and outer parts of lower bearings are fixed to a bottom plate 8 of the crystallizer frame 1 through a corresponding lower bearing fixing device 10.

An upper part of each screw 16 is fixed to an inner part of an upper bearing, a hand wheel is assembled at a top end of each screw, and outer parts of the upper bearings are fixed to the top plate of the crystallizer frame through a corresponding upper bearing fixing device 15.

The top plate and the bottom plate 8 of the crystallizer frame 1 are fixed together through a plurality of support rods.

Figure 5:
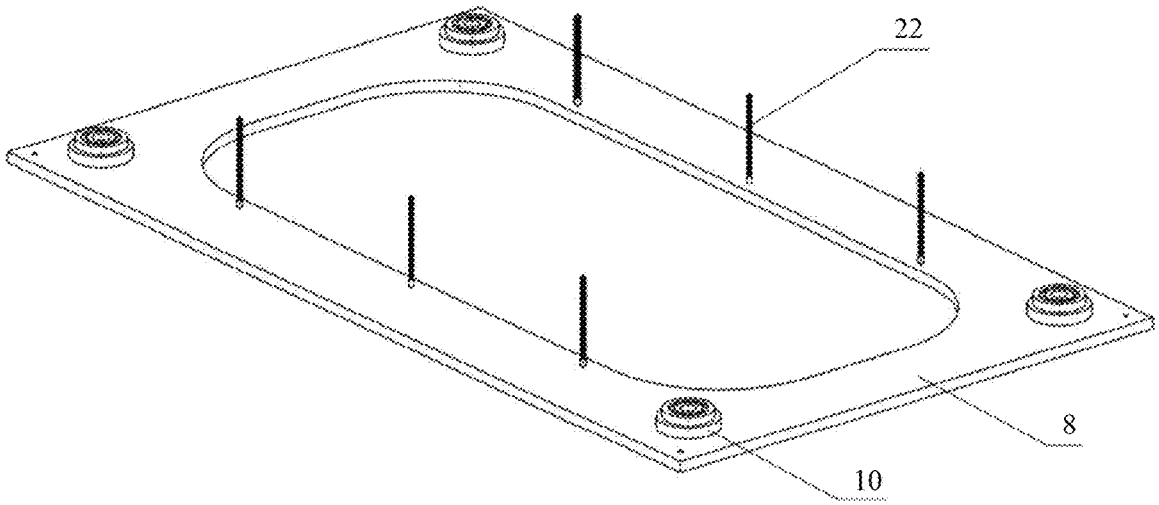
FIG. 5 shows a perspective view of the structure of the part of a bottom plate in FIG. 1.

The tertiary cooling water cavity 7 is located below the secondary cooling water cavity 9, a plurality of water outlet holes are formed in the tertiary cooling water cavity 7 and face to a side wall of the internal sleeve 3 or below the internal sleeve 3. Six fixing plates are arranged on an outer wall of the tertiary cooling water cavity 7, a plurality of internal thread holes are formed in the fixing plates respectively, and a plurality of screw rods 22 assembled on the bottom plate 8 of the crystallizer frame 1 (as shown in FIG. 5) are respectively threaded into the internal thread holes in the fixing plates. As shown in FIG. 5, a casting billet passage is formed in the bottom plate 8 of the crystallizer frame 1.

Two water inlets are formed in the primary cooling water cavity 12 and two water inlets are formed in the secondary cooling water cavity 9, and each water inlet communicates with a water inlet pipe.

The water outlets of the primary cooling water cavity 12 and the secondary cooling water cavity 9 are respectively divided into an upper row and a lower row, a distance between every two adjacent water outlets in the upper row is 5-20 mm, and a distance between every two adjacent water outlets in the lower row is 5-20 mm.

The upper interface plate 4 is an integral structure formed by a horizontal annular plate and a perpendicular annular plate, the horizontal annular plate is mutually perpendicular with the perpendicular annular plate, and the horizontal annular plate is located on an outer side of the perpendicular annular plate. A top surface of the horizontal annular plate is connected with a bottom surface of the connecting plate, and a bottom surface of the horizontal annular plate is connected with a top surface of the top plate of the crystallizer frame 1. A plurality of bolt holes of the perpendicular annular plate correspond to a plurality of thread holes in the internal sleeve respectively, the perpendicular annular plate is fixed to the internal sleeve through a plurality of bolts 21 which are threaded into the bolt holes and the thread holes. And the perpendicular annular plate is located between an inner end surface of the central hole of the top plate of the crystallizer frame 1 and an outer wall of the internal sleeve 3.

A horizontal section of the internal sleeve 3 is rectangle with round corners. An inner wall surface of the internal sleeve 3 is parallel to an axis of the internal sleeve 3. A perpendicular section of a lower part of an outer wall surface of the internal sleeve 3 is a wedge, and a part where the perpendicular section is the wedge is located below the bottom plate 8 of the crystallizer frame 1.

The screws 16 are arranged on the crystallizer frame 1 in total. Hand wheels assembled at top ends of the four screws 16 are respectively a first hand wheel 2, a second hand wheel 5, a third hand wheel 6 and a fourth hand wheel 11. Two lifting plates are arranged on the primary cooling water cavity 12 and two lifting plates are arranged on the secondary cooling water cavity 9. Two of the screws 16 are respectively threaded into two internal thread holes on the two lifting plates of the primary cooling water cavity 12, and two of the screws 16 are respectively threaded into two internal thread holes on the two lifting plates of the secondary cooling water cavity. The first hand wheel 2, the second hand wheel 5, the third hand wheel 6 and the fourth hand wheel 11 are distributed along a circumferential direction of the crystallizer frame 1, the first hand wheel 2 and the third hand wheel 6 are assembled on the two screws 16 connected with the primary cooling water cavity 12, and the second hand wheel 5 and the fourth hand wheel 11 are assembled on the two screws 16 connected with the secondary cooling water cavity 9.

The excitation coil 14 in the primary cooling water cavity 12 s is fixed to a bolt through two coil pressing plates 13 and the excitation coil 14 in the secondary cooling water cavity 9 is fixed to a bolt through two coil pressing plates 13. As shown in FIG. 3, a plurality of cable through holes 17 are respectively formed in side walls of the primary cooling water cavity 12 and the secondary cooling water cavity 9, and a plurality of cables (not shown) connected with the excitation coils 14 penetrate through the cable through holes 17 to be connected with a power supply (not shown).

As shown in FIG. 3, the primary cooling water cavity 12 and the secondary cooling water cavity 9 both consist of a water cavity external sleeve 20 and a water cavity cover plate 19. The water cavity external sleeve 20 of the primary cooling water cavity 12 is an integral structure formed by an outer side wall, an inner side wall and a water cavity bottom plate, and the water cavity external sleeve 20 of the secondary cooling water cavity 9 is an integral structure formed by an outer side wall, an inner side wall and a water cavity bottom plate. The water cavity cover plate 19 of the primary cooling water cavity 12 covers on top of the water cavity external sleeve 20 of the primary cooling water cavity 12 and is connected with the water cavity external sleeve 20 of the primary cooling water cavity 12 through a plurality of bolts, a sealing groove is formed in the water cavity cover plate 19 of the primary cooling water cavity 12, and the water cavity cover plate 19 of the primary cooling water cavity 12 and the water cavity external sleeve 20 of the primary cooling water cavity 12 are sealed through a sealing gasket. The water cavity cover plate 19 of the secondary cooling water cavity 9 covers on top of the water cavity external sleeve 20 of the secondary cooling water cavity 9 and is connected with the water cavity external sleeve 20 of the secondary cooling water cavity 9 through a plurality of bolts, a sealing groove is formed in the water cavity cover plate 19 of the secondary cooling water cavity 9, and the water cavity cover plate 19 of the secondary cooling water cavity 9 and the water cavity external sleeve 20 of the secondary cooling water cavity 9 are sealed through a sealing gasket. Two of the lifting plates are arranged on an outer side wall of the water cavity external sleeve 20 of the primary cooling water cavity 12 and two of the lifting plates are arranged on an outer side wall of the water cavity external sleeve 20 of the secondary cooling water cavity 9, the water inlets and the cable through holes are formed in the outer side wall of the water cavity external sleeve 20 of the primary cooling water cavity 12 and the outer side wall of the water cavity external sleeve 20 of the secondary cooling water cavity 9, and the water outlets are formed in an inner side wall of the water cavity external sleeve 20 of the primary cooling water cavity 12 and an inner side wall of the water cavity external sleeve 20 of the secondary cooling water cavity 9.

Each of the water outlets of the primary cooling water cavity 12 and the secondary cooling water cavity 9 both is an internal thread structure, and the water outlets and the adjustable spherical nozzles are assembled together through threads.

Prepared casting billets are ZK60 magnesium alloy flat billets, and are 225 mm in thickness, 500 mm in width and 5000 mm in length, and a width-to-thickness ratio is 2.22; and example ingredients contain the following components in percentage by mass of 5.5% of Zn, 0.45% of Zr, less than 0.001% of Fe, and the balance magnesium.

Figure 6:
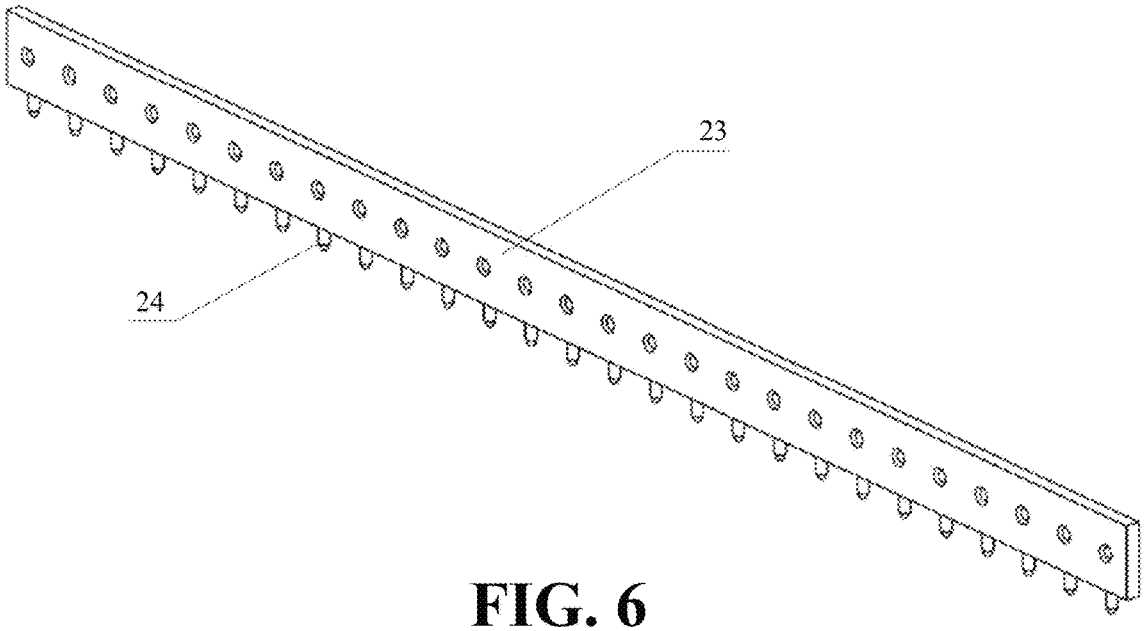
FIG. 6 shows a perspective view of the structure of a direction adjusting device according to the embodiment 1 of the present invention.

An electromagnetic semi-continuous casting method for the device, comprises the following steps:

Adjusting the angles of the adjustable spherical nozzles 18 through a direction adjusting device. As shown in FIG. 6, the direction adjusting device consists of a flat plate 23 and a plurality of terminals 24 fixed on the flat plate 23, and an arrangement mode of the terminals 24 corresponds to an arrangement mode of a part of the adjustable spherical nozzles 18. When the angles of the adjustable spherical nozzles 18 are adjusted through the direction adjusting device, each terminal 24 is inserted into a nozzle hole of the corresponding adjustable spherical nozzle 18, the flat plate 23 is turned over, at the same time, the included angle between a part of the adjustable spherical nozzles 18 and the water level is adjusted once. A plurality of adjusting holes are also formed in the flat plate 23, and are used for adjusting an extension pipe (not shown) of each adjustable spherical nozzle 18 with the extension pipe.

Inserting a dummy bar head (not shown) in a bottom of the internal sleeve 3.

Feeding cooling water to the primary cooling water cavity 12 and the secondary cooling water cavity 9, and then spraying the cooling water to the outer wall of the internal sleeve 3 through the adjustable spherical nozzles 18 of the primary cooling water cavity 12 and the secondary cooling water cavity 9. The cooling water sprayed from the primary cooling water cavity 12 is called primary cooling water, the cooling water sprayed from the secondary cooling water cavity 9 is called secondary cooling water, the primary cooling water and the secondary cooling water flow towards the lower part of the internal sleeve 3 along the outer wall of the internal sleeve 3, and a magnetic field is exerted on an inner part of the internal sleeve 3 through the excitation coils 14.

Enabling ZK60 magnesium alloy melts to be smelted, firstly enabling pure magnesium to be melted, then respectively adding other alloy elements, after refining, performing standing at 700-710° C. for 45 min, placing a shunting device (not shown) in the internal sleeve 3, pouring the melts into the internal sleeve 3 through a chute (not shown) under a condition of protection with mixed gas of $SF_6$ and $CO_2$, gradually solidifying the melts under an action of cooling of the internal sleeve 3 and an action of the magnetic field to form casting billets at the bottom of the internal sleeve 3. When the melts in the internal sleeve 3 achieve a set height (a liquid level is 30-40 mm away from an upper edge of the internal sleeve 3), starting the dummy bar head to enable solidified casting billets to move downwards, beginning to perform casting continuously. At this time, maintaining the liquid level stable and smooth, preventing fierce lifting and fluctuation, and controlling a temperature of the melts in the shunting device to be 670-680° C.

When bottom ends of the casting billets are separated from the internal sleeve 3, the primary cooling water and the secondary cooling water flow to surfaces of the casting billets from the internal sleeve 3. At this time, tertiary cooling water is sprayed to an outer wall surface of the internal sleeve 3 or the surfaces of the casting billets through the tertiary cooling water cavity 7, and the casting billets continue reducing temperature until the continuous casting is completed. A casting speed is 35-45 mm/min, a total flow of the primary cooling water is 200-250 L/min, and a wide-surface (single-side) flow of the primary cooling water is 45-85 L/min.

A flow ratio of the secondary cooling water to the primary cooling water is 1.0, a flow ratio of narrow-surface secondary cooling water to wide-surface secondary cooling water is 0.9, and a flow ratio of narrow-surface primary cooling water to wide-surface primary cooling water is 0.9.

A flow ratio of the tertiary cooling water to the primary cooling water is 0.5.

The screws 16 rotate through rotating the hand wheels, so that a height of the primary cooling water cavity or a height of the secondary cooling water cavity can be adjusted. A height difference between the water cavity cover plate 19 of the primary cooling water cavity 12 and the top plate of the crystallizer frame 1 is 0.2 H, and a height difference between the water cavity cover plate 19 of the secondary cooling water cavity 9 and the water cavity bottom plate of the primary cooling water cavity 12 is 0.6 H.

A height of the tertiary cooling water cavity 7 is adjusted through rotating the screw rods 22 assembled on the bottom plate of the crystallizer frame 1. The water outlet holes of the tertiary cooling water cavity 7 face to a lower part of a bottom end of the internal sleeve 3, and a perpendicular distance between the tertiary cooling water cavity 7 and the secondary cooling water cavity 9 is 60 mm.

Figure 7:
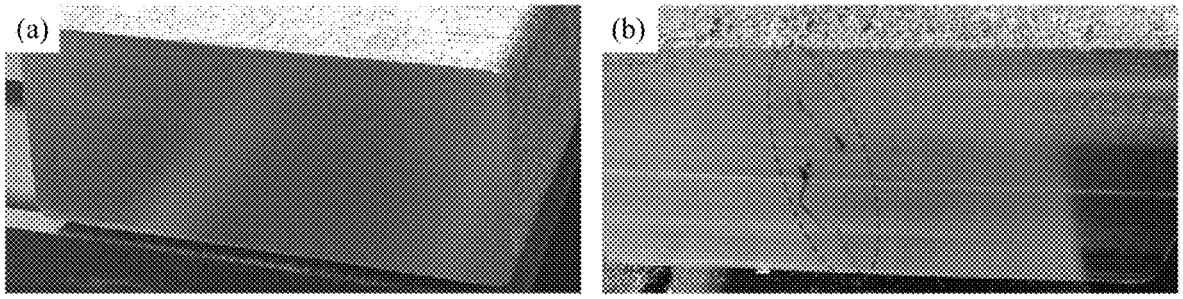
FIG. 7 shows appearance graph images of ZK60 flat billets respectively prepared according to the embodiment 1 of the present invention and a traditional casting manner/ FIG. 7 (*a*) shows the appearance graph image of the ZK60 flat billets prepared according to the embodiment 1, and FIG. 7 (*b*) shows the appearance graph image of ZK60 flat billets prepared according to the traditional casting manner.

The obtained casting billets are uniform in structure and good in metallurgical quality, cracks are not generated. Appearance graphs are shown in FIG. 7(*a*), the casting billets are uniform in structure in a width direction and a thickness direction of the casting billets, Zn elements and Zr elements are uniform in distribution, a segregation rate of the casting billets is obviously reduced, a yield rate of alloys easy to crack is remarkably increased, and a metallurgical quality of the casting billets is remarkably improved. Casting billets of the same material and the same size are prepared through a conventional casting crystallizer, appearance graphs are shown in FIG. 7(*b*), and obvious cracks exist in a lined region in the FIG. 7(*b*).

Embodiment 2

The device in the embodiment 2 has the same structure as that in the embodiment 1, except that:

The horizontal section of the internal sleeve 3 is round.

An included angle of 5 degrees is formed between the inner side wall of the internal sleeve 3 and the axis of the internal sleeve 3, and a section area of a top portion of an inner space of the internal sleeve 3 is smaller than a section area of a bottom portion of the internal sleeve 3.

The method in the embodiment 2 is the same as that in the embodiment 1, except that:

The casting billets are magnesium rare earth alloy (Mg-4Al-3La-1.5Gd-0.5Mn) round billets, and a diameter is 400 mm.

A flow ratio of the secondary cooling water to the primary cooling water is 0.8 without differences in wide surfaces of the casting billets and narrow surfaces of the casting billets.

A flow ratio of the tertiary cooling water to the primary cooling water is 0.8.

A height difference between the water cavity cover plate 19 of the primary cooling water cavity 12 and the top plate of the crystallizer frame 1 is 0 H, and a height difference between the water cavity cover plate 19 of the secondary cooling water cavity 9 and the water cavity bottom plate of the primary cooling water cavity 12 is 0.3 H.

The water outlet holes of the tertiary cooling water cavity 7 is controlled to face the lower part of the bottom end of the internal sleeve 3, and a perpendicular distance between the tertiary cooling water cavity 7 and the secondary cooling water cavity 9 is 150 mm.

Figure 8:
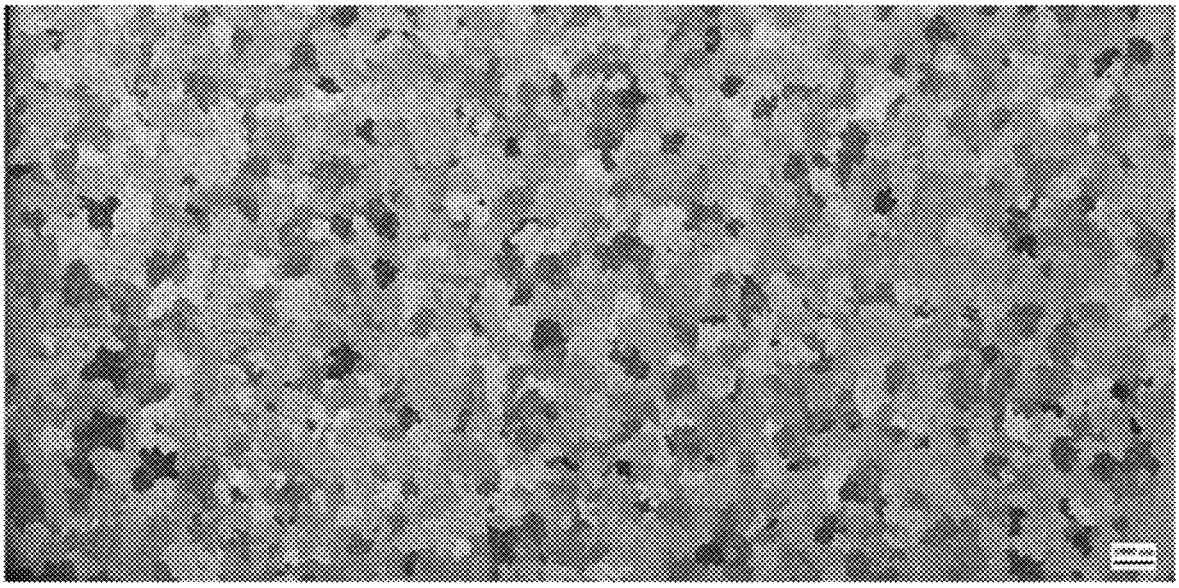
FIG. 8 shows a metallographic image of a macroscopic structure of round billets according to an embodiment 2 of the present invention.

The obtained casting billets are uniform in structure and good in metallurgical quality, and cracks are not generated. The macroscopic structure of the casting billets is shown in FIG. 8, and grains are obviously refined in size and uniform in distribution.

Embodiment 3

The device in the embodiment 3 has the same structure as that in the embodiment 1, except that:

The horizontal section of the internal sleeve 3 is round.

An included angle of 5 degrees is formed between the inner side wall of the internal sleeve 3 and the axis of the internal sleeve 3, and a section area of a top portion of an inner space of the internal sleeve 3 is smaller than the section area of the top portion of the internal sleeve 3.

The method in the embodiment 3 is the same as that in the embodiment 1, except that:

The casting billets are magnesium alloy (Mg-5Li-3Al-2Zn-0.2Y) round billets, and a diameter is 380 mm.

A flow ratio of the secondary cooling water to the primary cooling water is 1.2 without differences in wide surfaces of the casting billets and narrow surfaces of the casting billets.

A flow ratio of the tertiary cooling water to the primary cooling water is 0.3.

A height difference between the water cavity cover plate 19 of the primary cooling water cavity 12 and the top plate of the crystallizer frame 1 is 0.5 H, and a height difference between the water cavity cover plate 19 of the secondary cooling water cavity 9 and the water cavity bottom plate of the primary cooling water cavity 12 is 1 H.

The water outlet holes of the tertiary cooling water cavity 7 is controlled to face the lower part of the bottom end of the internal sleeve 3, and a perpendicular distance between the tertiary cooling water cavity 7 and the secondary cooling water cavity 9 is 120 mm.

Figure 9:
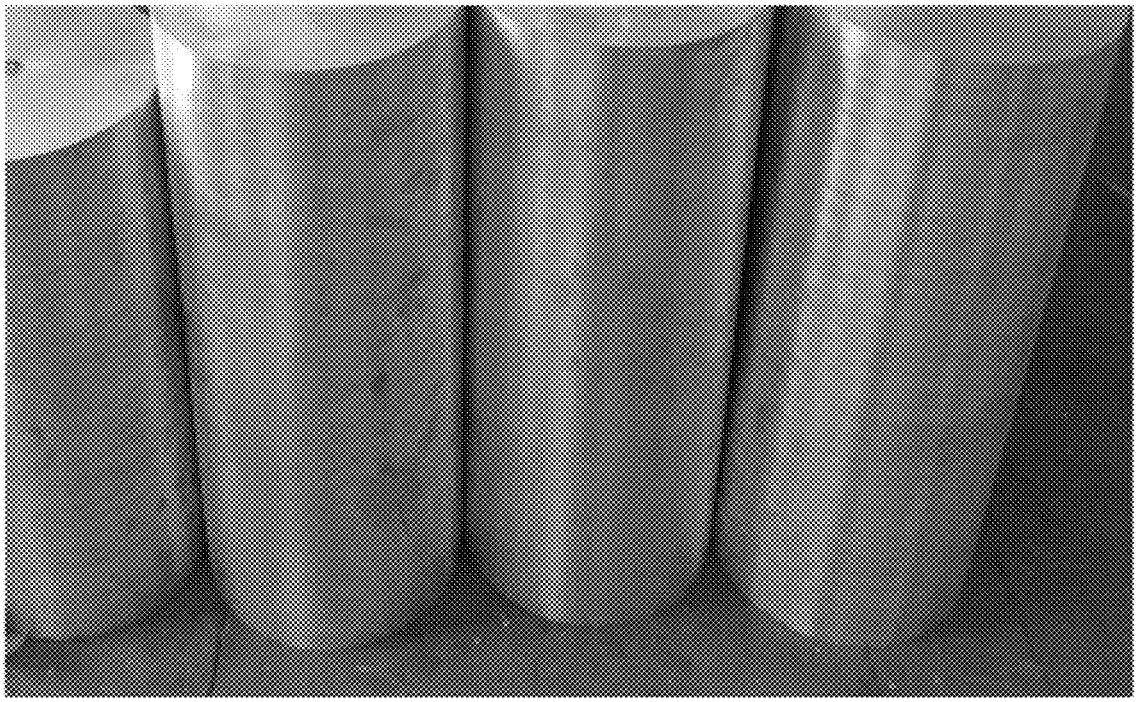
FIG. 9 shows an appearance graph image of turned surfaces of the round billet according to an embodiment 3 of the present invention.

The turned appearance of the surfaces of the obtained casting billets is shown in FIG. 9, and the casting billets are good in surface quality, compact in internal structure and free from shrinkage porosity and cracks.

The above implementation methods are merely intended to describe the preferable implementation of the present invention, rather than to limit the application scope of the present invention, and without departing from the thinking of the present invention, various modifications and improvement on the present invention shall fall within the protection scope of the present invention.

What is claimed is:

1. An electromagnetic semi-continuous casting device, comprising a crystallizer frame, an internal sleeve, a primary cooling water cavity, a secondary cooling water cavity, a tertiary cooling water cavity, at least four lifting plates and at least two fixing plates;

wherein a central hole is formed in a top plate of the crystallizer frame, and an upper interface plate is placed in the central hole;

wherein the internal sleeve is barrel-shaped, a connecting plate is fixed to an outer wall of an upper part of the internal sleeve, and the internal sleeve is located in the upper interface plate and is fixedly connected with the upper interface plate;

wherein the primary cooling water cavity and the secondary cooling water cavity are arranged outside the internal sleeve in a circumferential direction, two excitation coils are respectively arranged in the primary cooling water cavity and the secondary cooling water cavity, and a plurality of adjustable spherical nozzles are assembled at a plurality of water outlets of the primary cooling water cavity and the secondary cooling water cavity respectively, and the adjustable spherical nozzles face to the internal sleeve;

wherein at least two lifting plates are arranged on outer walls of the primary cooling water cavity and at least two lifting plates are arranged on outer walls of the secondary cooling water cavity, each of the lifting plate is formed with an internal thread hole, a plurality of screws are respectively threaded into the internal thread holes on the lifting plates, a bottom end of each screw is fixed to a lower bearing, and outer parts of the lower bearings are fixed to a bottom plate of the crystallizer frame;

wherein an upper part of each screw is fixed to an inner part of an upper bearing, a hand wheel is assembled at a top end of each screw, and outer parts of the upper bearings are fixed to the top plate of the crystallizer frame;

wherein the top plate and the bottom plate of the crystallizer frame are fixed together through a plurality of support rods;

wherein the tertiary cooling water cavity is located below the secondary cooling water cavity, a plurality of water outlet holes is formed in the tertiary cooling water cavity and face to a side wall of the internal sleeve or below the internal sleeve, at least two fixing plates are arranged on an outer wall of the tertiary cooling water cavity, a plurality of internal thread holes are formed in the fixing plates respectively, and a plurality of screw rods assembled on the bottom plate of the crystallizer frame are respectively threaded into the internal thread holes in the fixing plates; and wherein a casting billet passage is formed in the bottom plate of the crystallizer frame.

2. The device according to claim 1, wherein the water outlets of the primary cooling water cavity and the secondary cooling water cavity are respectively divided into an upper row and a lower row, an inner diameter of each of the adjustable spherical nozzles at each of the water outlets is 1-4 mm, a distance between every two adjacent water outlets in the upper row is 5-20 mm, and a distance between every two adjacent water outlets in the lower row is 5-20 mm.

3. The device according to claim 1, wherein the upper interface plate is an integral structure formed by a horizontal annular plate and a perpendicular annular plate, the horizontal annular plate is mutually perpendicular with the perpendicular annular plate, and the horizontal annular plate is located on an outer side of the perpendicular annular plate; wherein a top surface of the horizontal annular plate is connected with the connecting plate, and a bottom surface of the horizontal annular plate is connected with the top plate of the crystallizer frame; and wherein a plurality of bolt holes of the perpendicular annular plate correspond to a plurality of thread holes in the internal sleeve respectively, the perpendicular annular plate is fixed to the internal sleeve through a plurality of bolts which are threaded into the bolt holes and the thread holes, and the perpendicular annular plate is located between an inner end surface of the top plate of the crystallizer frame and the outer wall of the internal sleeve.

4. The device according to claim 1, wherein a horizontal section of the internal sleeve is round or rectangle with round corners; wherein an inner wall surface of the internal sleeve is parallel to an axis of the internal sleeve, or an included angle which is smaller than or equal to 5 degrees is formed between the inner wall surface of the internal sleeve and the axis of the internal sleeve; wherein when the included angle is formed between the inner wall surface of the internal sleeve and the axis of the internal sleeve, a section area of a top portion of an inner space of the internal sleeve is smaller than that of a bottom portion of the internal sleeve; and wherein a perpendicular section of a lower part of an outer wall surface of the internal sleeve is a wedge, and a part where the perpendicular section is the wedge is located below the bottom plate of the crystallizer frame.

5. The device according to claim 1, further comprising four screws; wherein the screws are arranged on the crystallizer frame in total, two lifting plates are arranged on the primary cooling water cavity and two lifting plates are arranged on the secondary cooling water cavity, two of the screws are respectively threaded into two internal thread holes on the two lifting plates of the primary cooling water cavity, and two of the screws are respectively threaded into two internal thread holes on the two lifting plates of the secondary cooling water cavity; and wherein the two screws threaded into the two internal thread holes on the two lifting plates of the primary cooling water cavity are called primary screws, the two screws threaded into the two internal thread holes on the two lifting plates of the secondary cooling water cavity are called secondary screws, and the two primary screws and the two secondary screws are in cross distribution in a circumferential direction of the crystallizer frame.

6. The device according to claim 1, wherein the excitation coil in the primary cooling water cavity is fixed to a bolt through two coil pressing plates, and the excitation coil in the secondary cooling water cavity is fixed to a bolt through two coil pressing plates; wherein a plurality of cable through holes are respectively formed in side walls of the primary cooling water cavity and the secondary cooling water cavity; and wherein a plurality of cables connected with the excitation coils penetrate through the cable through holes to be connected with a power supply.

7. The device according to claim 1, wherein the primary cooling water cavity and the secondary cooling water cavity both consist of a water cavity external sleeve and a water cavity cover plate; wherein the water cavity external sleeve of the primary cooling water cavity is an integral structure formed by an outer side wall, an inner side wall and a water cavity bottom plate, and the water cavity external sleeve of the secondary cooling water cavity is an integral structure formed by an outer side wall, an inner side wall and a water cavity bottom plate; wherein the water cavity cover plate of the primary cooling water cavity covers on top of the water cavity external sleeve of the primary cooling water cavity and is connected with the water cavity external sleeve of the primary cooling water cavity through a plurality of bolts, a sealing groove is formed in the water cavity cover plate of the primary cooling water cavity, and the water cavity cover plate of the primary cooling water cavity and the water cavity external sleeve of the primary cooling water cavity are sealed through a sealing gasket; wherein the water cavity cover plate of the secondary cooling water cavity covers on top of the water cavity external sleeve of the secondary cooling water cavity and is connected with the water cavity external sleeve of the secondary cooling water cavity through a plurality of bolts, a sealing groove is formed in the water cavity cover plate of the secondary cooling water cavity, and the water cavity cover plate of the secondary cooling water cavity and the water cavity external sleeve of the secondary cooling water cavity are sealed through a sealing gasket and wherein two of the lifting plates are arranged on an outer side wall of the water cavity external sleeve of the primary cooling water cavity and two of the lifting plates are arranged on an outer side wall of the water cavity external sleeve of the secondary cooling water cavity, a plurality of water inlets and a plurality of cable through holes are formed in the outer side wall of the water cavity external sleeve of the primary cooling water cavity and the outer side wall of the water cavity external sleeve of the secondary cooling water cavity, and the water outlets are formed in an inner side wall of the water cavity external sleeve of the primary cooling water cavity and an inner side wall of the water cavity external sleeve of the secondary cooling water cavity.

8. An electromagnetic semi-continuous casting method for the device according to claim 1, comprising the following steps:

(1) adjusting angles of the adjustable spherical nozzles;

(2) inserting a dummy bar head in a bottom of the internal sleeve;

(3) feeding cooling water to the primary cooling water cavity and the secondary cooling water cavity, and then spraying the cooling water to an outer wall of the internal sleeve through the adjustable spherical nozzles of the primary cooling water cavity and the secondary cooling water cavity; wherein the cooling water sprayed from the primary cooling water cavity is called primary cooling water, the cooling water sprayed from the secondary cooling water cavity is called secondary cooling water, the primary cooling water and the secondary cooling water flow towards the lower part of the internal sleeve along the outer wall of the internal sleeve, and a magnetic field is exerted on an inner part of the internal sleeve through the excitation coils;

(4) Pouring melts into the internal sleeve through a chute, and gradually solidifying the melts under an action of cooling of the internal sleeve and an action of the magnetic field to form casting billets at the bottom of the internal sleeve, when the melts in the internal sleeve achieve a set height, starting the dummy bar head to enable solidified casting billets to move downwards, and beginning to perform continuous casting;

(5) when bottom of the casting billets are separated from the internal sleeve, enabling the primary cooling water and the secondary cooling water to flow to surfaces of the casting billets from the internal sleeve, at this time, spraying tertiary cooling water to an outer wall surface of the internal sleeve or the surfaces of the casting billets through the tertiary cooling water cavity, and reducing temperature of the casting billets until the continuous casting is completed.

9. The method according to claim 8, wherein when the casting billets are round billets, a flow ratio of the secondary cooling water to the primary cooling water is 0.8-1.2, whereby an accurately matched and adjusted cooling process can be achieved; and wherein when the casting billets are flat billets, a flow ratio of the secondary cooling water to the primary cooling water is 0.8-1.2, besides, a flow ratio of the secondary cooling water of a narrow surface of each casting billet to the secondary cooling water of a wide surface of each casting billet is 0.8-1.0, and a flow ratio of the primary cooling water of the narrow surface of each casting billet to the primary cooling water of the wide surface of each casting billet is 0.8-1.0, whereby an accurately matched and adjusted cooling process can be achieved.

10. The method according to claim 8, wherein the casting billets are round billets or flat billets, a diameter of the round billets is 300-800 mm, a width of the flat billets is 500-1800 mm, and a width-to-thickness ratio of the flat billets is 1-5.

* * * * *